US009793594B2

(12) United States Patent
Zhao et al.

(10) Patent No.: US 9,793,594 B2
(45) Date of Patent: Oct. 17, 2017

(54) DIELECTRIC RESONATOR/FILTER HAVING A HOLLOW DIELECTRIC CYLINDER WITH PRE-DEFINED AREAS PLATED WITH SILVER

(71) Applicant: ZTE Corporation, Shenzhen (CN)

(72) Inventors: Lijuan Zhao, Shenzhen (CN); Nan Shen, Shenzhen (CN); Wende Bai, Shenzhen (CN); Hong Zhou, Shenzhen (CN)

(73) Assignee: XI'AN ZTE NEW SOFTWARE COMPANY LIMITED, Xi'An (CN)

( * ) Notice: Subject to any disclaimer, the term of this patent is extended or adjusted under 35 U.S.C. 154(b) by 0 days.

(21) Appl. No.: 14/773,731

(22) PCT Filed: Sep. 29, 2013

(86) PCT No.: PCT/CN2013/084647
§ 371 (c)(1),
(2) Date: Sep. 8, 2015

(87) PCT Pub. No.: WO2014/134915
PCT Pub. Date: Sep. 12, 2014

(65) Prior Publication Data

US 2016/0049717 A1 Feb. 18, 2016

(30) Foreign Application Priority Data

Mar. 8, 2013 (CN) ..... 2013 1 0075884

(51) Int. Cl.
*H01P 1/20* (2006.01)
*H01P 7/10* (2006.01)
*H01P 1/208* (2006.01)

(52) U.S. Cl.
CPC ..... *H01P 7/10* (2013.01); *H01P 1/2084* (2013.01)

(58) Field of Classification Search
CPC ..... H01P 1/2084; H01P 1/208; H01P 7/10
(Continued)

(56) References Cited

U.S. PATENT DOCUMENTS 4,603,311 A * 7/1986 Mage ..... H01P 1/203 333/202
4,855,693 A 8/1989 Matsukura et al.
(Continued)

FOREIGN PATENT DOCUMENTS

CN 1330430 A 1/2002
CN 102368574 A 3/2012
CN 102931463 A 2/2013

OTHER PUBLICATIONS

International Search Report issued Feb. 6, 2014 re: Application No. PCT/CN2013/084647; citing: CN 1330430 A, CN 102368574 A, CN 102931463 A, U.S. Pat. No. 4,855,693 A.

*Primary Examiner* — Benny Lee
(74) *Attorney, Agent, or Firm* — Cantor Colburn LLP

(57) ABSTRACT

A dielectric resonator and a dielectric filter are provided. The inner wall or the outer wall of the dielectric resonator is plated with silver. With the technical solution, it can be guaranteed that the volume of a dielectric resonant column of which the inner wall or the outer wall is plated with silver is reduced by about 35% as compared with the volume of an ordinary dielectric filter, or the volume of the dielectric resonator is reduced under the condition of the same cavity body. In addition, the dielectric resonator is stable and reliable in filtering performance, simple in production process, and overcomes the defect of large size of the universal dielectric resonator in the related art in the low communication frequency band.

6 Claims, 4 Drawing Sheets

(58) Field of Classification Search
USPC ..... 333/202, 219.1
See application file for complete search history.

(56) References Cited

U.S. PATENT DOCUMENTS

| | | | | |
|---|---|---|---|---|
| 5,557,246 | A * | 9/1996 | Ishihara et al. ..... | H01P 1/2053 333/206 |
| 6,169,467 | B1 * | 1/2001 | El-Sharawy ..... | H01P 7/10 331/107 DP |
| 6,750,739 | B2 * | 6/2004 | Enokihara et al. ..... | H01P 7/10 333/202 |
| 2011/0128097 | A1 * | 6/2011 | Park et al. ..... | H01P 7/10 333/219.1 |

* cited by examiner

DIELECTRIC RESONATOR/FILTER HAVING A HOLLOW DIELECTRIC CYLINDER WITH PRE-DEFINED AREAS PLATED WITH SILVER

TECHNICAL FIELD

The present disclosure relates to the field of communication, and in particular to a dielectric resonator and a dielectric filter.

BACKGROUND

A filter is a device which allows useful signals to pass while inhibiting interference signals. At present, base station filters available in the market mainly are metallic cavity filters. With the development of communication technologies and the intensive utilization of frequency spectrum resources, a radio system has higher requirements in the radio signals, and demands high-power transmitting and high-sensitivity receiving. However, the performance and volume of metallic cavity filters cannot satisfy these requirements; under such a circumstance, a dielectric filter is becoming widely used due to its low loss.

The dielectric constant of a Transverse Magnetic (TM) dielectric filter is the key factor to determine the size of the filter. At present, mature products available in the market are two types of dielectric resonators, where one type of dielectric resonator has a dielectric constant being 35 and the other type of dielectric resonator has a dielectric constant being 45. The two types of dielectric resonators have a relatively larger size in the low communication frequency band and require a larger single-cavity volume. For example, a dielectric resonator and a dielectric filter are provided in the related art. As shown in FIG. 1, the dielectric resonator includes a dielectric resonant column 102 and a metallic cavity 104, wherein the dielectric resonant column 102 is located in the metallic cavity 104, and the bottom of the dielectric resonant column 102 contacts the bottom of the metallic cavity 104; the dielectric resonator further includes a cover plate 103 and a conducting elastomer 101, wherein the cover plate 103 is used to seal the metallic cavity 104; the conducting elastomer 101 is located between the cover plate 103 and the dielectric resonant column 102 to connect the cover plate 103 and the dielectric resonant column 102. The dielectric filter ensures a fine contact between the dielectric resonant column and the cover plate relying on the resilience of the conducting elastomer caused by compression. The dielectric resonator is connected only by several contacts of a reed; moreover, when the cavity is expanded or contracted with the temperature, the contact area and the contact depth of the contact also changes, thereby leading to a change in the performance characteristic of the filter. The dielectric resonator has a relatively lower efficiency and a relatively larger volume.

In view of the problem that the dielectric filter in the related art has a low space utilization rate and has a large volume in a low frequency band, no solution has been proposed so far.

SUMMARY OF THE INVENTION

In view of the problem that the dielectric resonator has a low efficiency and has a large volume in the related art, the embodiments of the present disclosure provide a dielectric resonator and a dielectric filter to solve the above problem.

According to one aspect of the embodiments of the present disclosure, a dielectric resonator is provided, wherein an inner wall and/or an outer wall of the dielectric resonator is plated with silver.

In an example embodiment, the dielectric resonator is a hollow cylinder.

In an example embodiment, the dielectric resonator is plated with silver in one of the following parts: inner surface and/or outer surface of the dielectric resonator; upper surface and lower surface of the dielectric resonator; a first pre-defined area of the inner surface and a second pre-defined area of the outer surface.

In an example embodiment, the first pre-defined area includes: a first cylindrical surface formed by taking a first height as the height and a horizontal cross-sectional perimeter of a geometrical body formed by the inner surface of the dielectric resonator as the side, wherein the first height is less than the height of the dielectric resonator; the second pre-defined area includes: a second cylindrical surface formed by taking a second height as the height and a horizontal cross-sectional perimeter of the geometrical body formed by the outer surface of the dielectric resonator as the side, wherein the second height is less than the height of the dielectric resonator.

According to another aspect of the embodiments of the present disclosure, a dielectric filter is provided, including: a metallic cavity, a sealing cover plate, a tuning screw, and one or more dielectric resonators described above.

In an example embodiment, the sealing cover plate is located on an upper surface of the metallic cavity to seal the metallic cavity.

In an example embodiment, the bottom of the metallic cavity includes one or more grooves, wherein the diameter of the one or more grooves is greater than the diameter of an outer surface of the dielectric resonator.

In an example embodiment, the tuning screw includes: screw with threads or polished-rod screw.

In an example embodiment, the tuning screw is plated with silver or copper.

With the above technical solution, the application of the dielectric resonator plated with silver and the dielectric filter solves the problem in the related art that the dielectric filter has a low space utilization rate and a large volume, thus the efficiency of the dielectric resonator is improved and the volume of the dielectric resonator is reduced.

BRIEF DESCRIPTION OF THE DRAWINGS

For a better understanding of the present disclosure, accompanying drawings described hereinafter are provided to constitute one part of the application; the schematic embodiments of the present disclosure and the description thereof are used to illustrate the present disclosure only, and not to improperly limit the present disclosure. In the accompanying drawings.

DETAILED DESCRIPTION OF THE PREFERRED EMBODIMENTS

The present disclosure is described below in detail by reference to the accompanying drawings in conjunction with the embodiments. It should be noted that the embodiments in the application and the characteristics of the embodiments can be combined if no conflict is caused.

Figure 1:
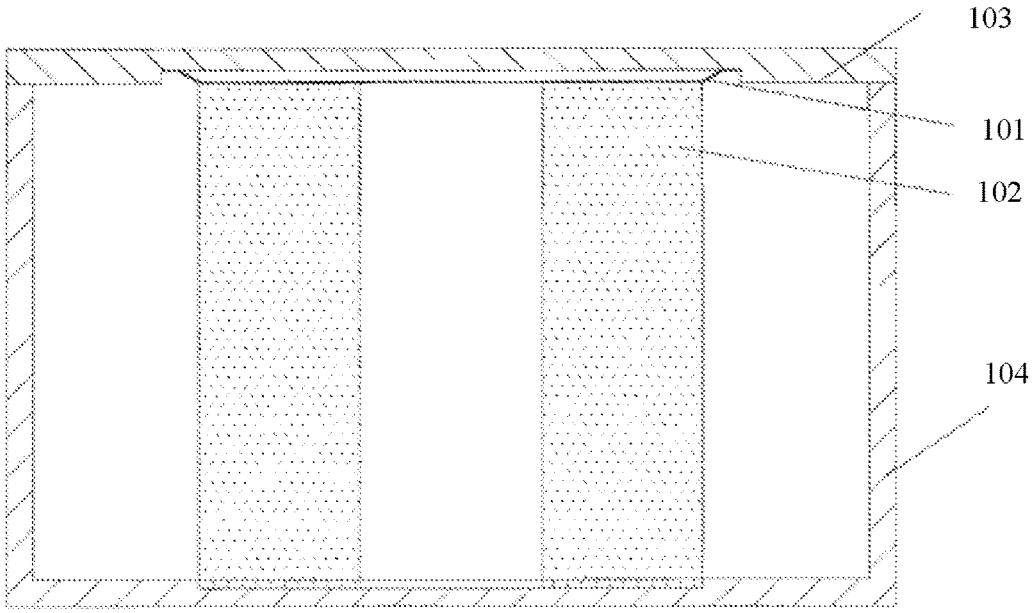
Related Art Fig. 1
FIG. 1 shows a diagram of a TM dielectric filter in the related art.
Figure 2:
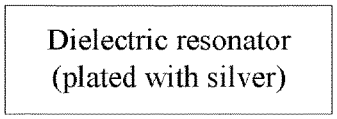
FIG. 2 shows a structure diagram of a dielectric resonator according to an embodiment of the present disclosure.

An embodiment provides a dielectric resonator. FIG. 2 shows a structure diagram of a dielectric resonator according to an embodiment of the present disclosure. As shown in FIG. 2, the inner wall and/or the outer wall of the dielectric resonator is plated with silver.

As an example embodiment, the dielectric resonator is a hollow cylinder, wherein the dielectric resonator may adopt a hollow column according to existing technologies (the dielectric resonator can be designed in several geometrical shapes according to requirements); for example, the dielectric resonator may adopt a hollow cylinder or polygon. The application of the hollow cylinder can reduce the production cost.

In an example embodiment, the dielectric resonator is plated with silver in one of the following parts: inner surface and/or outer surface of the dielectric resonator; upper surface and lower surface of the dielectric resonator; a first pre-defined area of the inner surface and a second pre-defined area of the outer surface.

In an example embodiment, the first pre-defined area includes: a first cylindrical surface formed by taking a first height as the height and the horizontal cross-sectional perimeter of the geometrical body formed by the inner surface of the dielectric resonator as the side, wherein the first height is less than the height of the dielectric resonator; the second pre-defined area includes: a second cylindrical surface formed by taking a second height as the height and the horizontal cross-sectional perimeter of the geometrical body formed by the outer surface of the dielectric resonator as the side, wherein the second height is less than the height of the dielectric resonator.

Figure 3:
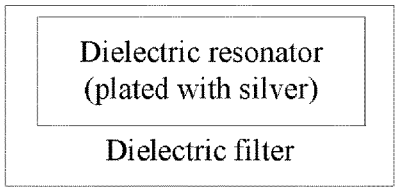
FIG. 3 shows a structure diagram of a dielectric filter according to an embodiment of the present disclosure.

According to another embodiment of the present disclosure, a dielectric filter is provided. The dielectric filter includes: a metallic cavity, a sealing cover plate, a tuning screw, and moreover, as shown in FIG. 3, further includes one or more dielectric resonators described above. Each dielectric resonator, of which the inner wall and/or the outer wall is plated with silver, can refer to the dielectric resonator described in the previous embodiment, the subsequent Example Embodiment 1, and the several implementations described below by reference to FIGS. 5, 6, 7 and 8.

In an example embodiment, the sealing cover plate is located on the upper surface of the metallic cavity to seal the metallic cavity.

In an example embodiment, the bottom of the metallic cavity includes one or more grooves, wherein the diameter of the one or more grooves is greater than the diameter of an outer surface of the dielectric resonator.

In an example embodiment, the tuning screw includes: screw with threads or polished-rod screw In an example embodiment, the tuning screw is plated with silver or copper.

The present disclosure is described below in conjunction with example embodiments. The embodiments describe below combines the above embodiments and example embodiments.

Example Embodiment 1

The embodiment of the present disclosure provides a processed dielectric resonator and a dielectric filter manufactured by using the dielectric resonator. The dielectric filter manufactured by the solution provided by this example embodiment has a smaller volume as compared with a dielectric filter manufactured by a related art while having the equivalent performance.

The embodiment of the present disclosure provides a dielectric resonator. The dielectric resonator is a hollow cylinder. Either the inner wall or the outer wall of the dielectric resonator is plated with silver. Alternatively, both the inner wall and the outer wall of the dielectric resonator may be plated with silver, for example, the lower part of the inner wall and the lower part of the outer wall of the dielectric resonant column may be plated with silver; or, the lower part of the inner wall and the upper part of the outer wall of the dielectric resonant column may be plated with silver; or, the upper part of the inner wall and the upper part of the outer wall of the dielectric resonant column may be plated with silver; or, the upper part of the inner wall and the lower part of the outer wall of the dielectric resonant column may be plated with silver. The upper surface and the lower surface of the dielectric resonator may be plated with silver.

The dielectric filter provided by the embodiment of the present disclosure includes one or more dielectric resonators plated with silver, a metallic cavity, a sealing cover plate and a tuning screw. The dielectric resonator is a hollow cylinder. Either the inner wall or the outer wall of the dielectric resonator is plated with silver. Alternatively, both the inner wall and the outer wall of the dielectric resonator may be plated with silver, for example, the lower part of the inner wall and the lower part of the outer wall of the dielectric resonant column may be plated with silver; or, the lower part of the inner wall and the upper part of the outer wall of the dielectric resonant column may be plated with silver; or, the upper part of the inner wall and the upper part of the outer wall of the dielectric resonant column may be plated with silver; or, the upper part of the inner wall and the lower part of the outer wall of the dielectric resonant column may be plated with silver. The upper surface and the lower surface of the dielectric resonator may be plated with silver. The dielectric resonator and the cavity are fixed together by pressing the sealing cover plate onto the cavity, wherein the sealing cover plate is located on the upper surface of the metallic cavity to seal the metallic cavity; the bottom of the cavity is provided with one or more grooves, of which the diameter is slightly greater than the diameter of the dielectric resonator; the tuning screw may be a screw with threads or a polished-rod screw, wherein the tuning screw is plated with silver or copper.

From experimental data it can be concluded that this design can reduce the volume of the filter, for example, if the dielectric resonator of the same size is used, the filter of the same frequency can be reduced by 35% in volume; or this design can improve the performance of the filter under the condition of the same volume and reduce the cost. Among the several silver plating modes, the best modes are the one of plating the inner wall with silver, and the one of plating the lower part of the inner wall with silver and plating the upper part of the outer wall with silver.

TABLE 1

| Single-Cavity Size (length *width *height) Unit: mm | Silver Plating Mode | Dielectric Resonator Size (where the former ϕ is inner diameter (unit: mm) of the dielectric resonant column and the later ϕ is outer diameter (unit: mm) of the dielectric resonant column) | Resonant Frequency (where G represents GHz, and M represents MHz) | Single-Cavity Q Value | High-Order Mode (where G represents GHz) |
|---|---|---|---|---|---|
| 34*34*23 | No | ϕ25ϕ8 | 1.08 G | 4175 | 1.69 G |
| 34*34*23 | No | ϕ30ϕ8 | 1.02 G | 3700 | 1.54 G |
| 42*42*23 | No | ϕ25ϕ8 | 938M | 4710 | 1.57 G |
| 34*34*23 | 7 mm-height lower part of inner wall | ϕ25ϕ8 | 936M | 3209 | 1.67 G |
| 34*34*23 | 7 mm-height upper part of inner wall | ϕ25ϕ8 | 933M | 3196 | 1.66 G |
| 34*34*23 | 7 mm-height upper part of outer wall | ϕ25ϕ8 | 1.01 G | 3229 | 1.53 G |
| 34*34*23 | 11.5 mm-height upper part of outer wall | ϕ25ϕ8 | 933M | 3196 | 1.66 G |
| 34*34*23 | 7 mm-height lower part of outer wall | ϕ25ϕ8 | 1.02 G | 3240 | 1.53 G |
| 34*34*23 | 11.4 mm-height lower part of outer wall | ϕ25ϕ8 | 933M | 2615 | 1.41 G |
| 34*34*23 | 7 mm-height upper part of inner wall and 3 mm-height upper part of outer wall | ϕ25ϕ8 | 938M | 2938 | 1.65 G |
| 34*34*23 | 7 mm-height lower part of inner wall and 3 mm-height upper part of outer wall | ϕ25ϕ8 | 920M | 3000 | 1.62 G |
| 34*34*23 | 7 mm-height lower part of inner wall and 1 mm-height lower part of outer wall | ϕ25ϕ8 | 937M | 3115 | 1.67 G |
| 34*34*23 | 7 mm-height upper part of inner wall and 1 mm-height lower part of outer wall | ϕ25ϕ8 | 938M | 3160 | 1.65 G |

The dielectric resonator and the dielectric filter provided in the embodiment achieve advantages of volume reduction, miniaturization, space saving and performance improvement of communication devices, as compared with the products in the related art.

Example Embodiment 2

The embodiment of the present disclosure provides a dielectric filter, which includes one or more dielectric resonant columns (one or more dielectric resonators), a sealing cover plate, a metallic cavity and a tuning screw. The dielectric resonant column is located inside the metallic cavity; the upper surface of the dielectric resonant column contacts the sealing cover plate and the lower surface of the dielectric resonant column contacts the bottom of the cavity.

In this example embodiment, the sealing cover plate is located on the upper surface of the metallic cavity to seal the metallic cavity. The tuning screw is assembled on the sealing cover plate. The sealing cover plate and the metallic cavity are sealed by a metallic screw.

Several implementations are described below by reference to FIGS. 5, 6, 7 and 8.

Figure 4:
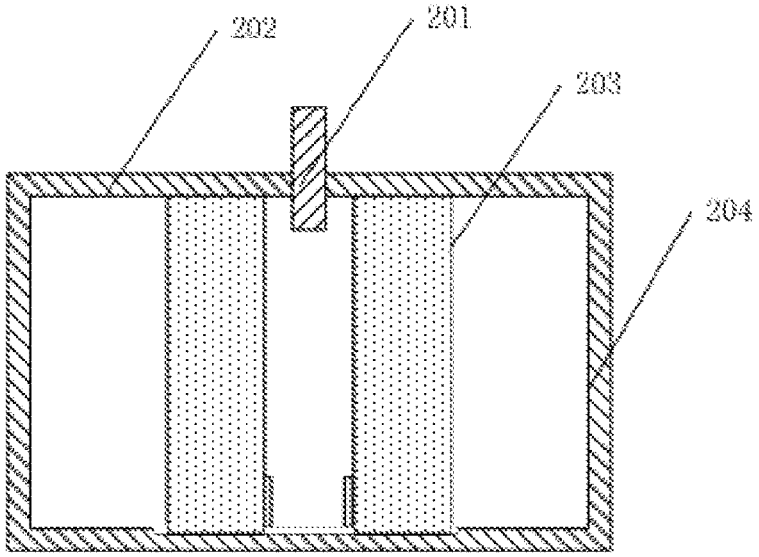
FIG. 4 shows a structure diagram 1 according to an example embodiment of the present disclosure.

FIG. 4 shows a structure diagram 1 according to an example embodiment of the present disclosure. As shown in FIG. 4, the dielectric filter includes a dielectric resonant column 203, a sealing cover plate 202, a metallic cavity 204 and a tuning screw 201.

The lower part of the inner wall of the dielectric resonant column 203 is plated with silver, wherein the height of the silver coating is about 3 mm; the size of the silver coating includes but is not limited to this size. The specific size can be adjusted according to a practically used frequency band and a given structure volume.

The bottom of the metallic cavity 204 is provided with a groove, wherein the diameter of the groove is slightly greater than the diameter of the dielectric resonant column, and the depth of the groove is about 0.5 mm. The size of the groove includes but is not limited to this size.

The dielectric resonant column 203 is located inside the metallic cavity 204, wherein the upper surface of the dielectric resonant column 203 is directly in press bond with the sealing cover plate 202.

The sealing cover plate 202 is located on the upper surface of the metallic cavity 204, that is, the top, to seal the metallic cavity 204.

The entire assembly process of the dielectric resonator is: first the dielectric resonator 203 is placed in the groove of the metallic cavity 204, second the sealing cover plate 202 is placed on the metallic cavity 204 and is fixed to seal the metallic cavity 204, and last the tuning screw 201 is assembled.

Figure 5:
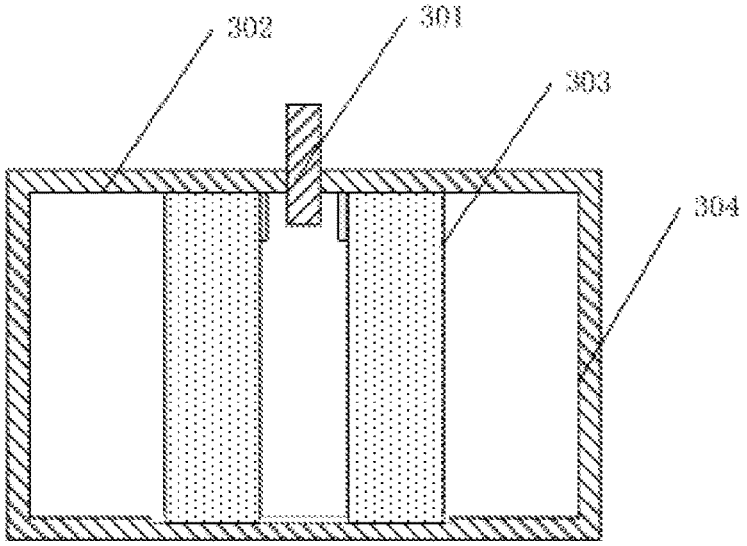
FIG. 5 shows a structure diagram 2 according to an example embodiment of the present disclosure.

FIG. 5 shows a structure diagram 2 according to an example embodiment of the present disclosure. The dielectric resonator includes a dielectric resonant column 303, a sealing cover plate 302, a metallic cavity 304 and a tuning screw 301.

The upper part of the inner wall of the dielectric resonant column 303 is plated with silver, wherein the height of the silver coating is about 3 mm; the size of the silver coating includes but is not limited to this size. The specific size can be adjusted according to a practically used frequency band and a given structure volume.

The bottom of the metallic cavity 304 is provided with a groove, wherein the diameter of the groove is slightly greater than the diameter of the dielectric resonant column, and the depth of the groove is about 0.5 mm. The size of the groove includes but is not limited to this size.

The dielectric resonant column 303 is located inside the metallic cavity 304, wherein the upper surface of the dielectric resonant column 303 is directly in press to bond with the sealing cover plate 302.

The sealing cover plate 302 is located on the upper surface of the metallic cavity 304, that is, the top, to seal the metallic cavity 304.

The entire assembly process of the dielectric resonator is: first the dielectric resonator 303 is placed in the groove of the metallic cavity 304, second the sealing cover plate 302 is placed on the metallic cavity 304 and is fixed to seal the metallic cavity 304, and last the tuning screw 301 is assembled.

Figure 6:
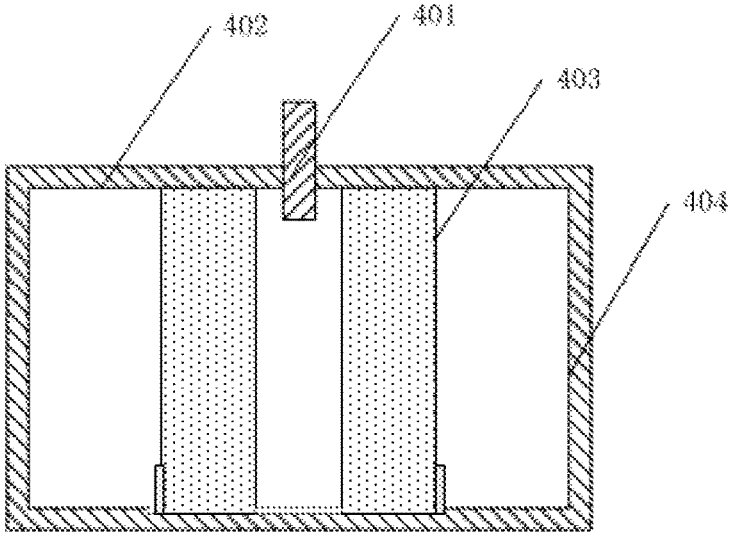
FIG. 6 shows a structure diagram 3 according to an example embodiment of the present disclosure.

FIG. 6 shows a structure diagram 3 according to an example embodiment of the present disclosure. As shown in FIG. 6, the dielectric resonator includes a dielectric resonant column 403, a sealing cover plate 402, a metallic cavity 404 and a tuning screw 401.

The lower part of the outer wall of the dielectric resonant column 403 is plated with silver, wherein the height of the silver coating is about 3 mm; the size of the silver coating includes but is not limited to this size. The specific size can be adjusted according to a practically used frequency band and a given structure volume.

The bottom of the metallic cavity 404 is provided with a groove, wherein the diameter of the groove is slightly greater than the diameter of the dielectric resonant column, and the depth of the groove is about 0.5 mm. The size of the groove includes but is not limited to this size.

The dielectric resonant column 403 is located inside the metallic cavity 404, wherein the upper surface of the dielectric resonant column 403 is directly in press bond with the sealing cover plate 402.

The sealing cover plate 402 is located on the upper surface of the metallic cavity 404, that is, the top, to seal the metallic cavity 404.

The entire assembly process of the dielectric resonator is: first the dielectric resonator 403 is placed in the groove of the metallic cavity 404, second the sealing cover plate 402 is placed on the metallic cavity 404 and is fixed to seal the metallic cavity 404, and last the tuning screw 401 is assembled.

Figure 7:
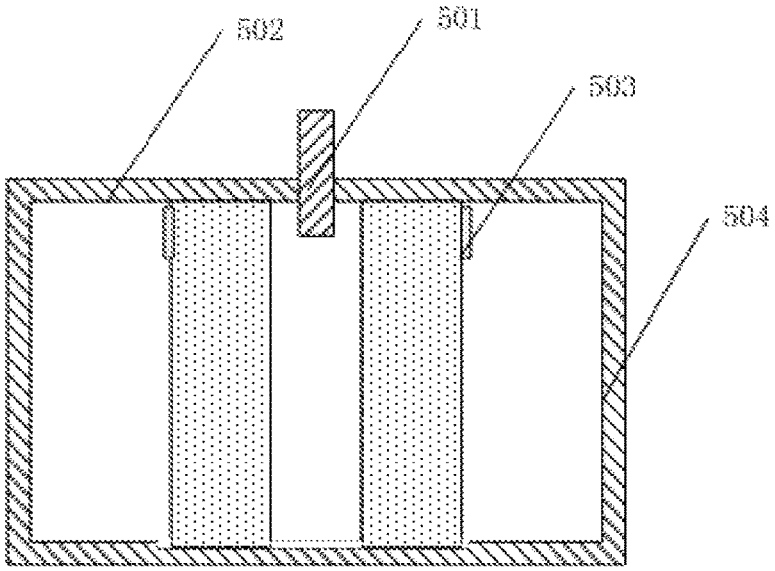
FIG. 7 shows a structure diagram 4 according to an example embodiment of the present disclosure.

FIG. 7 shows a structure diagram 4 according to an example embodiment of the present disclosure. As shown in FIG. 7, the dielectric resonator includes a dielectric resonant column 503, a sealing cover plate 502, a metallic cavity 504 and a tuning screw 501.

The upper part of the outer wall of the dielectric resonant column 503 is plated with silver, wherein the height of the silver coating is about 3 mm; the size of the silver coating includes but is not limited to this size. The specific size can be adjusted according to a practically used frequency band and a given structure volume.

The bottom of the metallic cavity 504 is provided with a groove, wherein the diameter of the groove is slightly greater than the diameter of the dielectric resonant column, and the depth of the groove is about 0.5 mm. The size of the groove includes but is not limited to this size.

The dielectric resonant column 503 is located inside the metallic cavity 504, wherein the upper surface of the dielectric resonant column 503 is directly in press bond with the sealing cover plate 502.

The sealing cover plate 502 is located on the upper surface of the metallic cavity 504, that is, the top, to seal the metallic cavity 504.

The entire assembly process of the dielectric resonator is: first the dielectric resonator 503 is placed in the groove of the metallic cavity 504, second the sealing cover plate 502 is placed on the metallic cavity 504 and is fixed to seal the metallic cavity 504, and last the tuning screw 501 is assembled.

Figure 8:
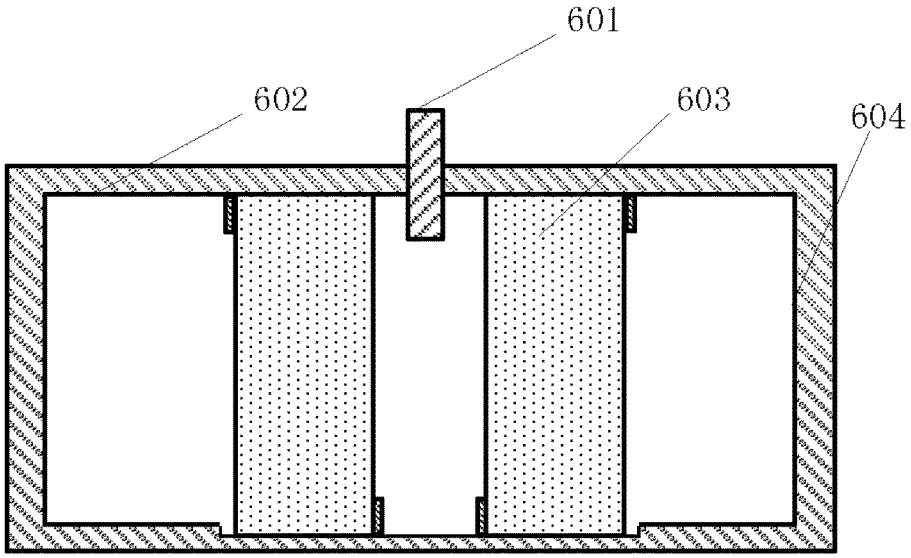
FIG. 8 shows a structure diagram 5 according to an example embodiment of the present disclosure.

FIG. 8 shows a structure diagram 5 according to an example embodiment of the present disclosure. As shown in FIG. 8, the dielectric resonator includes a dielectric resonant column 603, a sealing cover plate 602, a metallic cavity 604 and a tuning screw 601.

The upper part of the outer wall and the lower part of the inner wall of the dielectric resonant column 603 are plated with silver, wherein the height of the silver coating is about 3 mm; the size of the silver coating includes but is not limited to this size. The specific size can be adjusted according to a practically used frequency band and a given structure volume.

The bottom of the metallic cavity 604 is provided with a groove, wherein the diameter of the groove is slightly greater than the diameter of the dielectric resonant column, and the depth of the groove is about 0.5 mm. The size of the groove includes but is not limited to this size.

The dielectric resonant column 603 is located inside the metallic cavity 604, wherein the upper surface of the dielectric resonant column 603 is directly in press bond with the sealing cover plate 602.

The sealing cover plate 602 is located on the upper surface of the metallic cavity 604, that is, the top, to seal the metallic cavity 604.

The entire assembly process of the dielectric resonator is: first the dielectric resonator 603 is placed in the groove of the metallic cavity 604, second the sealing cover plate 602 is placed on the metallic cavity 604 and is fixed to seal the metallic cavity 604, and last the tuning screw 601 is assembled.

The dielectric filter provided by the embodiments of the present disclosure may include one or more of the dielectric resonators described in the above embodiments. The dielectric filter is a multi-order dielectric filter formed by one or more dielectric resonators connected together.

Throughout the above embodiments, a dielectric resonator and a dielectric filter are provided. Through the dielectric resonator provided by the above example embodiment, it can be guaranteed that the volume of a dielectric resonant column of which the inner wall or the outer wall is plated with silver is reduced by about 35% as compared with the volume of an ordinary dielectric filter, or the volume of the dielectric resonator is reduced under the condition of the same cavity body. In addition, the dielectric resonator is stable and reliable in filtering performance, simple in production process, overcomes the defect of large size of the universal dielectric resonator in the related art in the low frequency communication band, and solves the problem of large volume of a TM dual-end short-circuit dielectric resonator in the related art. It should be noted that not all the above implementations can achieve these technical effects and some technical effects can be achieved by certain example implementations only.

INDUSTRIAL APPLICABILITY

Through the technical solution of the present disclosure, it can be guaranteed that the volume of a dielectric resonant column of which the inner wall or the outer wall is plated with silver is reduced by about 35% as compared with the volume of an ordinary dielectric filter, or the volume of the dielectric resonator is reduced under the condition of the same cavity body. In addition, the dielectric resonator is stable and reliable in filtering performance and simple in production process.

Obviously, those skilled in the art should understand that the modules or steps described above can be implemented by a common computer device; the modules or steps can be integrated on a single computing device or distributed on a network composed of a plurality of computing devices; optionally, the modules or steps can be implemented by a programming code executable by a computing device, thus they can be stored in a storage device to be executed by a computing device, or to manufactured into individual integrated circuit module respectively, or several of them can be manufactured into a single integrated circuit module to implement; in this way, the present disclosure is not limited to any combination of specific hardware and software.

The above are only the example embodiments of the present disclosure and not intended to limit the present disclosure. For those skilled in the art, various modifications and changes can be made to the present disclosure. Any modification, equivalent substitute and improvement made within the principle of the present disclosure shall fall within the scope of protection defined by the claims of the present disclosure.

The invention claimed is:

1. A dielectric resonator, wherein the dielectric resonator is a hollow cylinder, and a first pre-defined area of an inner surface of the dielectric resonator and a second pre-defined area of an outer surface of the dielectric resonator are plated with silver;

wherein the first pre-defined area comprises: a first cylindrical surface, wherein the height of the first cylindrical surface is a first height, and the side of the first cylindrical surface is a horizontal cross-sectional perimeter of a first virtual geometrical body formed by the inner surface of the dielectric resonator, wherein the first height is less than a height of the dielectric resonator;

the second pre-defined area comprises: a second cylindrical surface, wherein the height of the second cylindrical surface is a second height, and the side of the second cylindrical surface is a horizontal cross-sectional perimeter of a second geometrical body formed by the outer surface of the dielectric resonator, wherein the second virtual height is less than the height of the dielectric resonator.

2. A dielectric filter, comprising: a metallic cavity, a sealing cover plate, a tuning screw, and one or more dielectric resonators disposed within the metallic cavity, wherein each of the one or more dielectric resonators is defined by the dielectric resonator according to claim 1.

3. The dielectric filter according to claim 2, wherein the bottom of the metallic cavity comprises one or more circular grooves, wherein the diameter of the one or more circular grooves is greater than the horizontal cross-sectional diameter of the second geometrical body formed by the outer surface of the dielectric resonator.

4. The dielectric filter according to claim 2, wherein the tuning screw comprises: screw with threads or polished-rod screw.

5. The dielectric filter according to claim 4, wherein the tuning screw is plated with silver or copper.

6. The dielectric filter according to claim 2, wherein the sealing cover plate is located on an upper surface of the metallic cavity to seal the metallic cavity.

* * * * *